US009767775B2

(12) United States Patent
Russo, Jr.

(10) Patent No.: US 9,767,775 B2
(45) Date of Patent: Sep. 19, 2017

(54) INSTRUMENT CASE WITH BUILT IN STAND

(71) Applicant: Joseph Thomas Russo, Jr., Hudson, MA (US)

(72) Inventor: Joseph Thomas Russo, Jr., Hudson, MA (US)

( * ) Notice: Subject to any disclaimer, the term of this patent is extended or adjusted under 35 U.S.C. 154(b) by 135 days.

(21) Appl. No.: 14/810,532

(22) Filed: Jul. 28, 2015

(65) Prior Publication Data

US 2017/0032772 A1 Feb. 2, 2017

(51) Int. Cl.

| | |
|---|---|
| ***G10G 5/00*** | (2006.01) |
| ***G10G 7/00*** | (2006.01) |
| ***A45C 11/00*** | (2006.01) |

(52) U.S. Cl.

CPC ..... *G10G 5/00* (2013.01); *A45C 11/00* (2013.01); *G10G 7/005* (2013.01)

(58) Field of Classification Search

CPC .. A45C 11/00; A47F 7/00; B65D 5/42; B65D 5/4204; B65D 25/10; B65D 25/22; B65D 25/28; G10G 5/00; G10G 7/00; G10G 7/005

USPC ..... 206/14, 45.2, 45.23, 45.24, 314; 84/327, 84/453

See application file for complete search history.

(56) References Cited

U.S. PATENT DOCUMENTS 3,866,877 A * 2/1975 Thompson ..... A47G 29/00 248/688
5,197,701 A * 3/1993 Olson ..... G10G 5/00 84/327
7,208,666 B2 * 4/2007 Burch ..... G10G 7/005 84/327
8,286,926 B1 * 10/2012 Van Dyne ..... G10G 5/00 248/165
8,348,055 B2 * 1/2013 Loban ..... G10G 7/005 206/314
9,251,772 B2 * 2/2016 Hungate ..... G10G 7/005
2013/0327662 A1 * 12/2013 Loban ..... G10G 7/005 206/314

FOREIGN PATENT DOCUMENTS

IT WO 2011138710 A1 * 11/2011 ..... G10G 5/00

* cited by examiner

*Primary Examiner* — Bryon Gehman

(74) *Attorney, Agent, or Firm* — Dunlap Bennett & Ludwig PLLC

(57) ABSTRACT

An instrument case with a built in stand is provided. The present invention includes an enclosure on a rear surface of the instrument case. The stand may include a deploy arm and a leg. The deploy arm includes a top end and a bottom end. The bottom end is pivotally secured within the enclosure bay. The leg is pivotally secured in between the top end and bottom end of the deploy arm. The leg includes slider pins slidably engaged with slots formed in the enclosure bay. The stand comprises a deployed position and a retracted position. The deployed position includes the deploy arm and the leg pivoted away from the enclosure bay and supporting the instrument case in an upright position of a surface. The retracted position includes the deploy arm and the leg pivoted towards the enclosure bay such that the instrument case is easy to transport.

10 Claims, 5 Drawing Sheets

INSTRUMENT CASE WITH BUILT IN STAND

BACKGROUND OF THE INVENTION

The present invention relates broadly to an instrument case and, more particularly, to an instrument case with a built in stand.

Professional and amateur musicians of stringed instruments, such as guitars, violins, and banjos etc. are very protective of their instruments which are typically delicate and expensive devices. Damage to stringed instruments can also affect the sound quality of the instrument as well as decrease its monetary value. These musicians of stringed instruments usually have at least two problems: one is the effort required to set up a separate instrument stand, then remove the instrument and peripherals from the case, placing the instrument on the stand, and then finding where to put their instrument case off stage while they are performing; another is the effort required to reverse the process after they have finished playing. For the musician, these efforts are at best time consuming and inconvenient. Stringed instrument stands, such as guitar stands, have typically been awkward to use. A musician must carry his or her instrument and stand together and then find a place where to set up their instrument case and stand so that they will not be in the way when playing or performing. Also, typical stands for stringed instruments offer only limited protection from falls or accidents. Transportation and storage is another concern. A musician on the go must transport and carry both their instrument and its stand separately. To a musician, having so many things to carry can be very encumbering. Then, one must find a corner of a room, or some other place off stage in which to lean the instrument case, adding additional inconvenience.

As can be seen, there is a need for an instrument case with a built in stand which overcomes the problems noted above and others previously experienced by musicians of stringed instruments.

SUMMARY OF THE INVENTION

In one aspect of the present invention, a stand for an object comprises: an enclosure bay either inserted into or formed onto a surface of the object; a deploy arm comprising a top end and a bottom end, wherein the bottom end is pivotally secured within the enclosure bay; a leg pivotally secured to the deploy arm in between the top end and bottom end, wherein the leg comprises slider pins slidably engaged with slots formed in the enclosure bay; and wherein the stand comprises a deployed position comprising the deploy arm and the leg pivoted away from the enclosure bay and a retracted position comprising the deploy arm and the leg pivoted towards the enclosure bay.

These and other features, aspects and advantages of the present invention will become better understood with reference to the following drawings, description and claims.

BRIEF DESCRIPTION OF THE DRAWINGS

The accompanying drawings, which are incorporated and constitute a part of this specification, illustrate an implementation of the present invention. The drawings herein, together with the descriptions, explain the principles and advantages of the invention.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
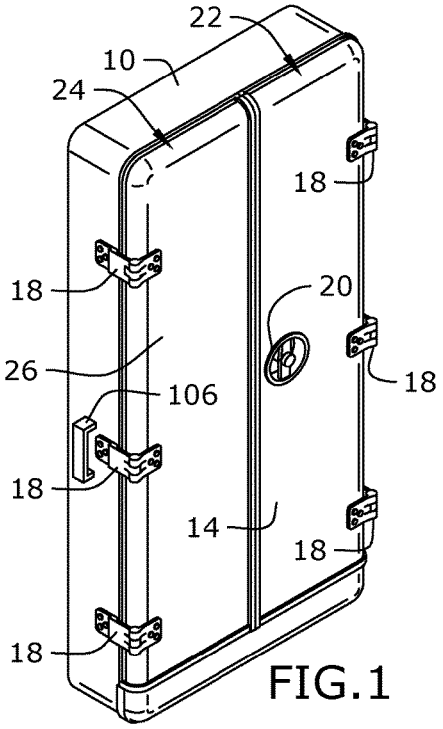
FIG. 1 is a front perspective view of the present invention shown in closed, locked and non-deployed configuration.
Figure 2:
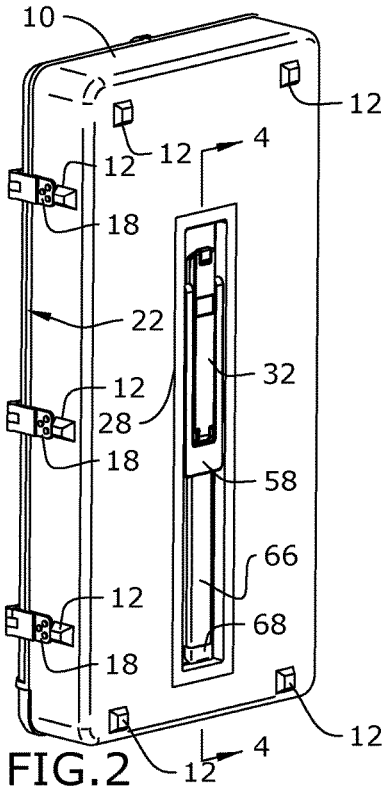
FIG. 2 is a rear perspective view of the present invention shown in closed, locked and non-deployed configuration.
Figure 3:
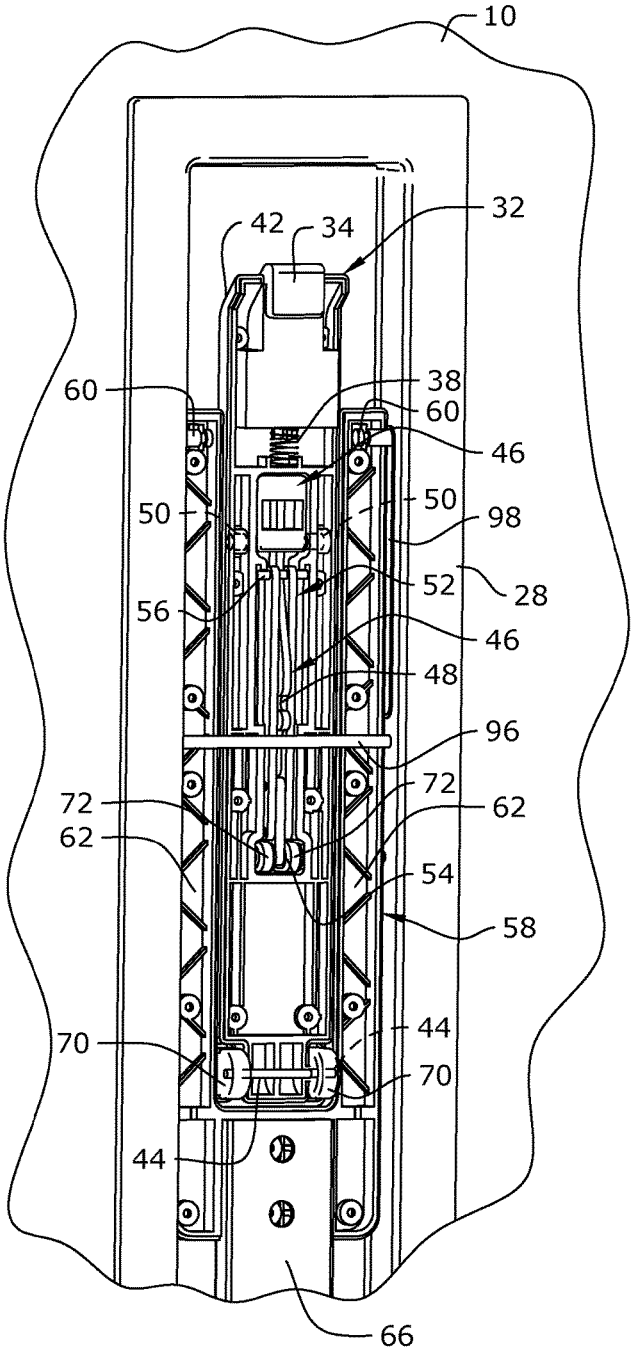
FIG. 3 is a rear detail perspective view of the present invention shown in locked and non-deployed configuration with components intentionally omitted for illustrative clarity.
Figure 4:
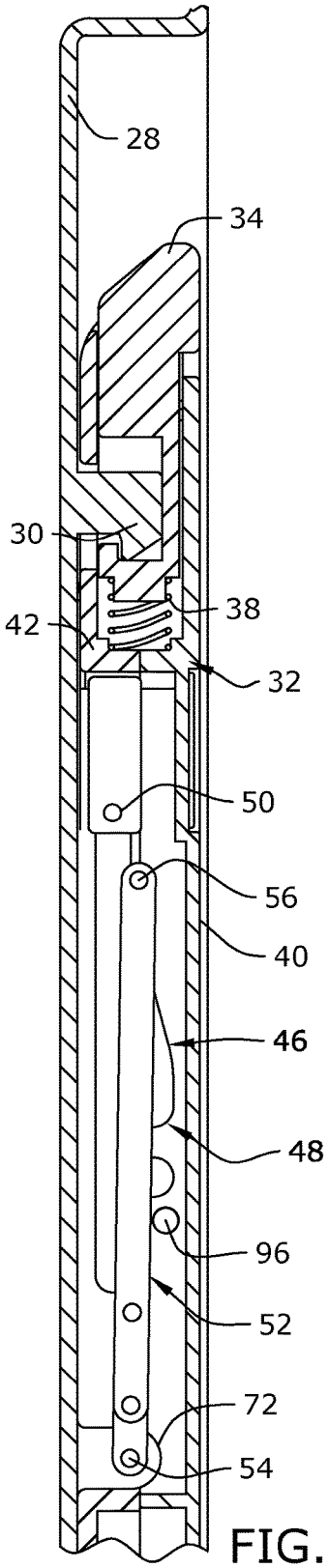
FIG. 4 is a section detail view of the present invention shown in locked and non-deployed configuration along line 4-4 in FIG. 2 and shown with multiple components non-sectioned for illustrative clarity.
Figure 5:
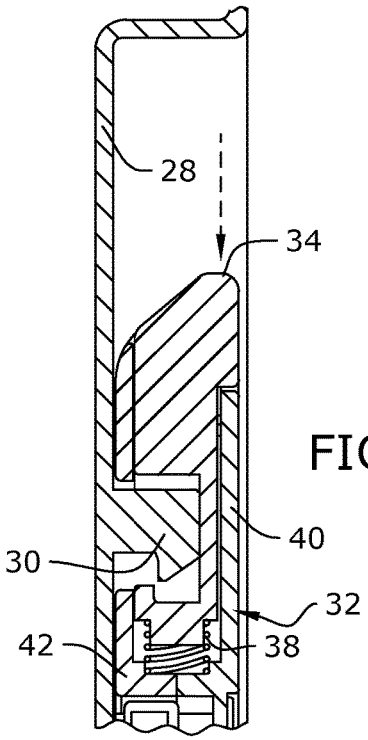
FIG. 5 is a section detail view of the present invention shown in non-deployed configuration with button lock depressed, and shown with multiple components non-sectioned for illustrative clarity.
Figure 6:
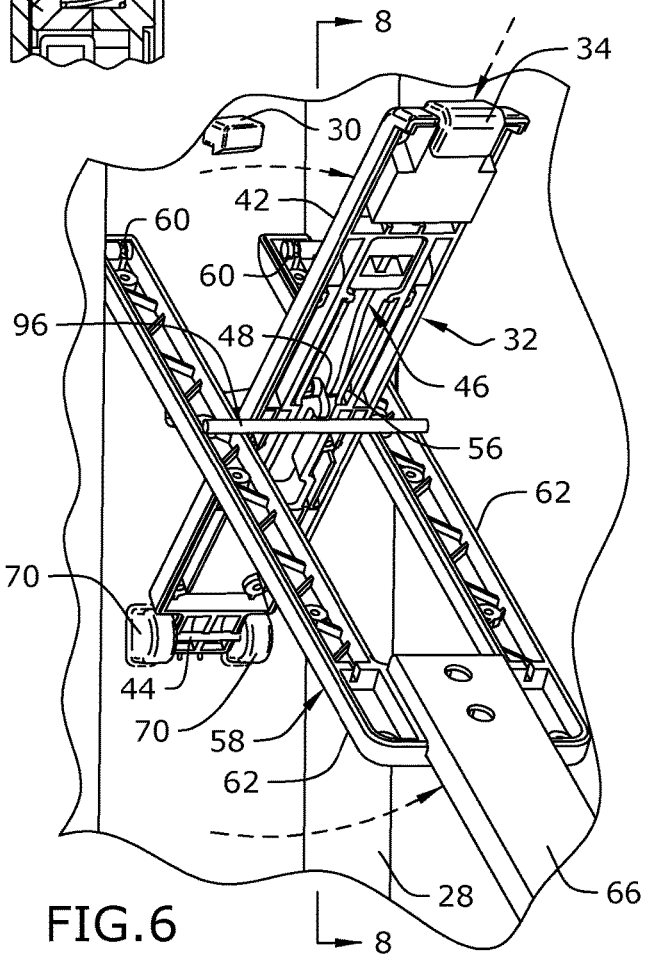
FIG. 6 is a rear perspective view of the present invention shown with rear components deployed and locked with components intentionally omitted for illustrative clarity.
Figures 7, 8:
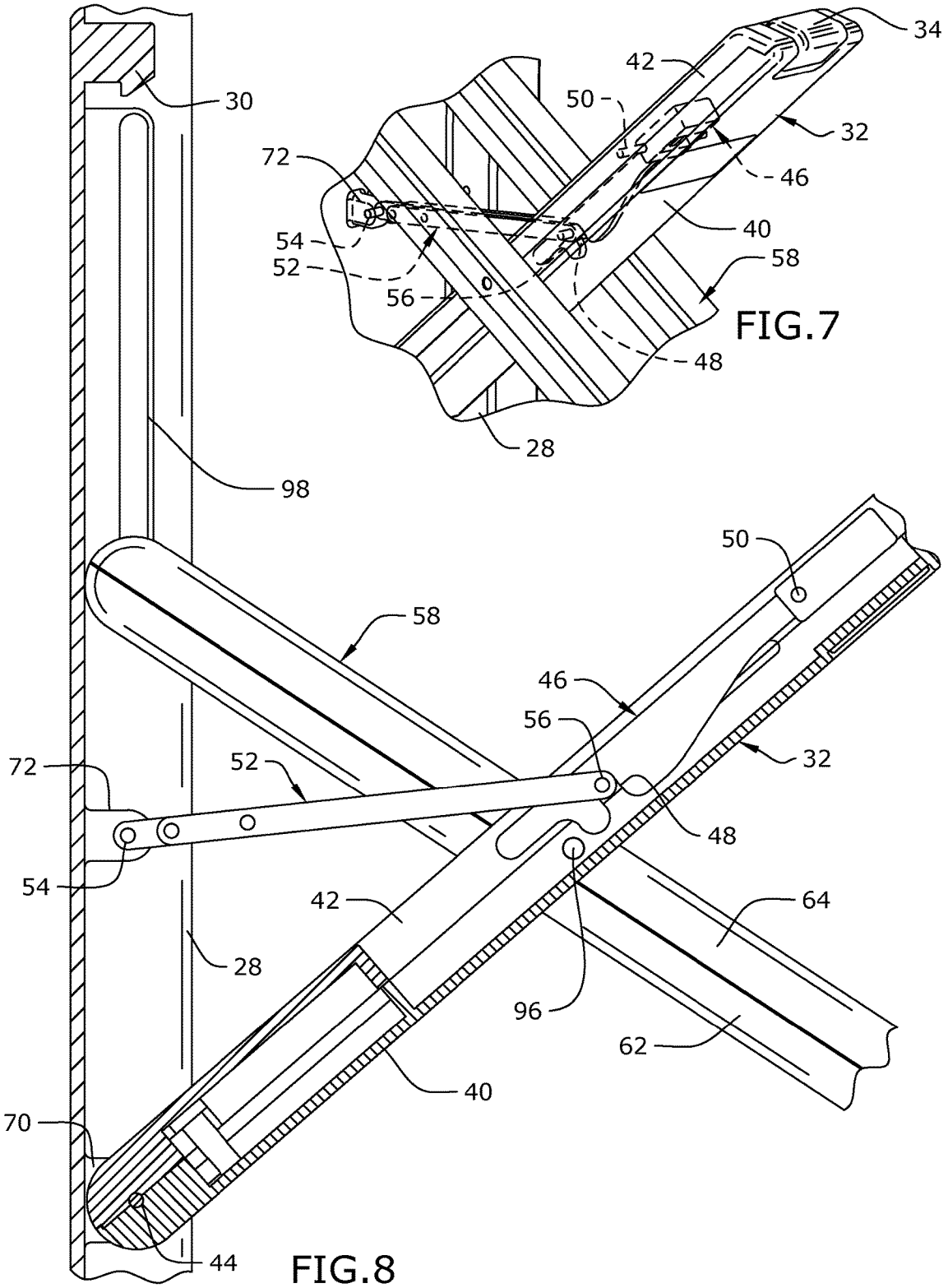
FIG. 7 is a rear perspective detail view of the present invention shown in a locked and deployed configuration.
FIG. 8 is a section view of the present invention shown in locked and deployed configuration along 8-8 in FIG. 6 and shown with multiple components non-sectioned for illustrative clarity.
Figure 9:
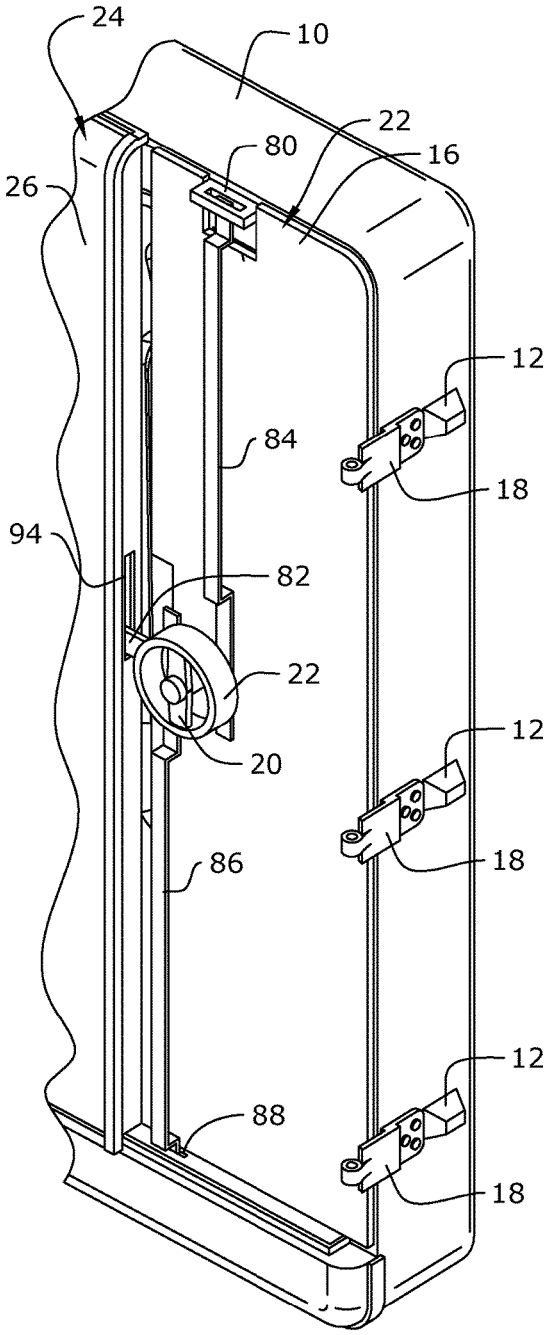
FIG. 9 is a front detail perspective view of the present invention shown with door components intentionally omitted for illustrative clarity.
Figure 10:
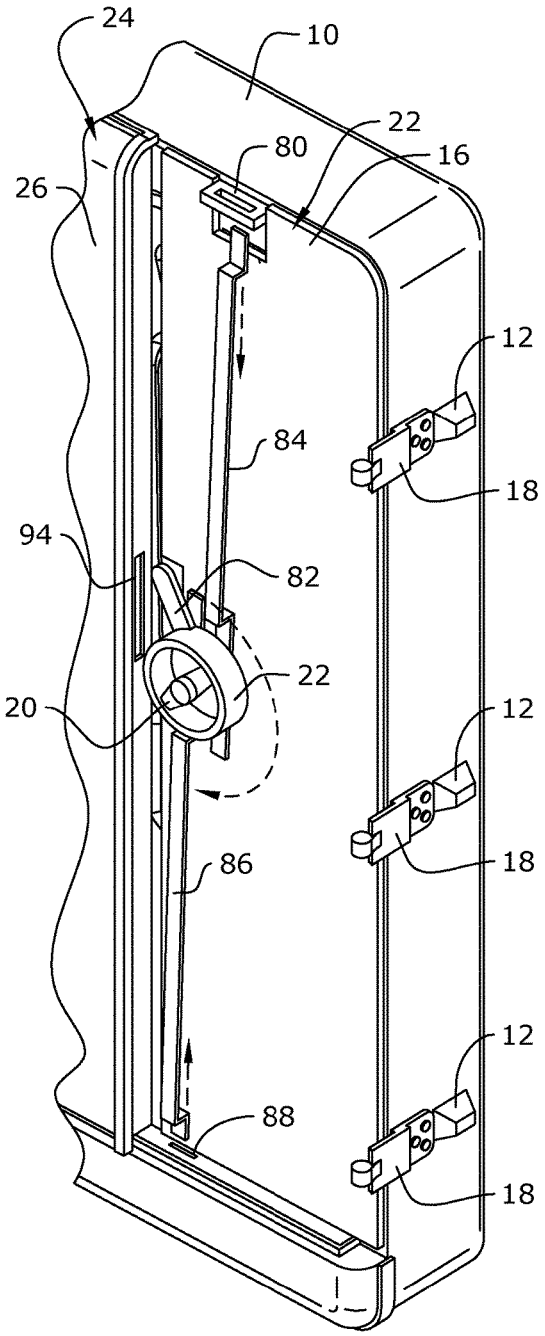
FIG. 10 is a front detail perspective view of the present invention shown with door components intentionally omitted for illustrative clarity.
Figure 11:
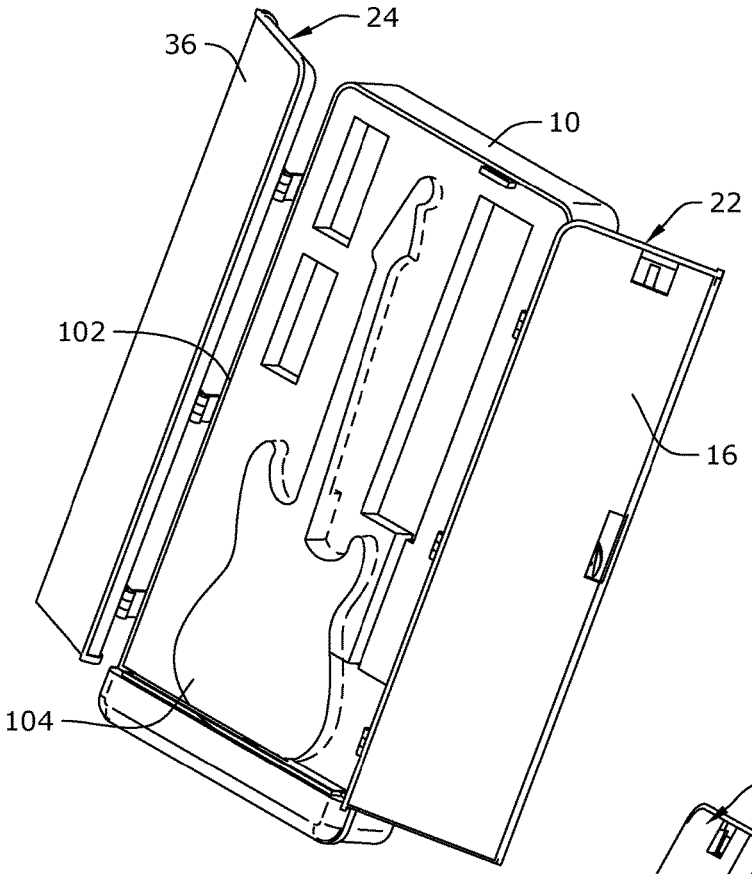
FIG. 11 is a perspective view of the present invention shown in use.
Figure 12:
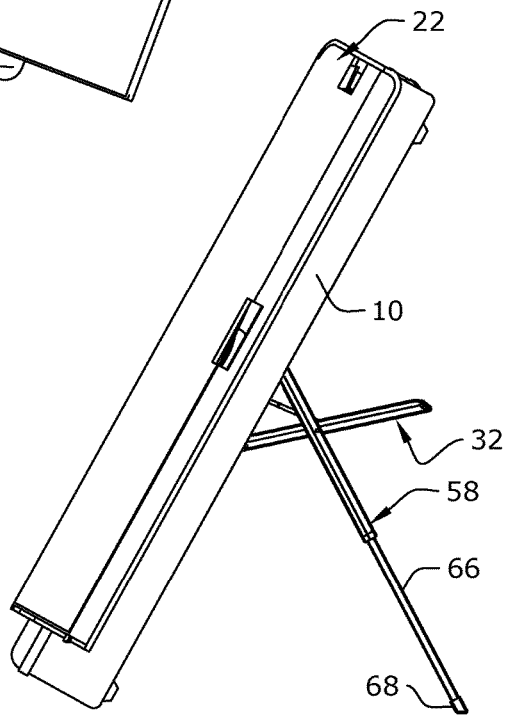
FIG. 12 is a side view of the present invention shown in use.

Referring to FIGS. 1 through 12, the present invention includes a stand. The stand of the present invention may be used to support any object in an upright position. The present invention includes an enclosure bay 28 either inserted into or formed onto a surface of the object. The stand may include a deploy arm 32 and a leg 58, 66. The deploy arm 32 includes a top end and a bottom end. The bottom end is pivotally secured within the enclosure bay 28. The leg 58, 66 is pivotally secured in between the top end and bottom end of the deploy arm 32. The leg 58, 66 includes slider pins 60 slidably engaged with slots 98 formed in the enclosure bay 28. The stand comprises a deployed position and a retracted position. The deployed position includes the deploy arm 32 and the leg 58, 66 pivoted away from the enclosure bay 28 and supporting the object in an upright position of a surface. The retracted position includes the deploy arm 32 and the leg 58, 66 pivoted towards the enclosure bay 28 such that the object is easy to transport.

The deploy arm 32 of the present invention may include a top housing 40 and a bottom housing 42 securing internal components within. The deploy arm 32 may be pivotally secured within the enclosure bay 28 by a pivot pin 44. The pivot pin 44 is fixed to the deploy arm 32 and pivotally secured within pivot protrusions 70 fixed within the enclosure bay 28.

The present invention may further include a rider arm 52. The rider arm 52 may also include a pivot pin 54 that is pivotally secured within pivot protrusions 72 fixed within the enclosure bay 28. The rider arm 52 is operable to pivot and releasably connect with the latch key 46 within the deploy arm 32 when the deploy arm 32 and the leg 58, 66 are in the deployed position. In certain embodiments, the rider arm 52 includes a body portion having a first end and a second end. The first end includes the pivot pin 54. A slot is formed along the length of the rider arm 52 and a key latch lock pin 56 is secured to the second end, bridging the formed slot within the rider arm 52.

In certain embodiments, the present invention includes a key latch 46. The key latch 46 includes a button head portion and a body portion. The key latch 46 is pivotally connected within the deploy arm 32 by a key latch pivot pin 50 in between the button head and the body portion. A notch 48 is formed in the body portion of the key latch 46 and is formed to receive the key latch lock pin 56 of the rider arm 52. In certain embodiments, the body portion of the key latch 46 tapers from a wide portion adjacent the notch 48 to the button head portion.

The present invention may further include a button lock latch 30. The button lock latch 30 may protrude from within the enclosure bay 28 and releasably secure the stand in the retracted position. The button lock latch 30 may include a hook with a beveled edge. The deploy arm 32 may include a button lock 34. The button lock 34 may be secured to the top end of the deploy arm 32 and may be spring biased away from the deploy arm 32 by a button lock spring 38. The button lock 34 may include a lock slot including a flange formed at an opening leading into the lock slot. The hook of the button lock latch 30 is sized to fit within the button lock slot.

The leg 58, 66 of the present invention may include an upper portion 58 and a lower portion 66. The upper portion 58 may include top housing 64 and a bottom housing 62, securing internal components within. The upper portion 58 may be formed of side bars spaced apart to receive the deploy arm 32 in between. Each of the side bars may include a slider pin 60 secured at a top end. The enclosure bay 28 may include two flanges extending on opposite sides forming the bay in between. Each of the flanges may include a slot 98 running partially along the flanges. The slider pins 60 slidably engage the enclosure bay 28 within the slots 98 when the stand is transitioning from the retracted position to the deployed position and from the deployed position to the retracted position. The lower portion 66 may include an elongated post extending downward from the upper portion with a rubber foot 68 secured to the tip, to increase stability when in the deployed position.

In certain embodiments, the leg 58, 66 may be pivotally connected to the deploy arm 32 by a pivot pin 96. In such embodiments, the pivot pin 96 may be secured to the top housing 64 and a bottom housing 62 of the side bars of the upper leg portion 58. The pivot pin 96 may run through the top housing 40 and the bottom housing 42 near a center portion of the deploy arm 32. Thus, the deploy arm 32 may pivot about the pivot pin 96, thereby pivotally connecting the leg 58, 66 and the deploy arm 32.

The object of the present invention may be an instrument case, such as a guitar case 10. The guitar case 10 includes a housing having a back surface. The enclosure bay 28 is either inserted into a recessed portion of the back surface or formed onto the back surface. The guitar case 10 may include a plurality of feet 12 attached to the outer surfaces. For example, the guitar case 10 may include a foot 12 secured to each corner of the bottom surface so that a user may rest the guitar case 10 on the ground without the use of a deployed stand. The guitar case 10 may further include a felt base 102 with felt fitted slots and pockets secured within the housing. A guitar 104 may fit within a felt fitted slot. The guitar case 10 may be carried when the stand is in the non-deployed position using a handle 106 secured to the outer surface.

The guitar case 10 of the present invention may include a right door 22 and a left door 24. The right door 22 and the left door 24 may be attached to the case housing by hinges 18. In certain embodiments, the right door 22 may include an outer casing 14 and an inner cover 16. A rotary handle 20 may be disposed in between the outer casing 14 and inner cover 16, and exposed through the outer casing 14. The present invention may include a locking mechanism. The locking mechanism may be disposed in between the outer casing 14 and the inner cover 16. A rotary handle latch 82 may be secured to the rotary handle 20. An upper latch rod 84 is secured to the rotary handle 20 and fits within a slot 80 formed in the case housing 10, and extruding through a notch 78 in the felt base 102. A lower latch rod 86 is secured to the rotary handle 20 and fits within a slot 88 formed in the case housing 10. The left door 24 may include an outer casing 26 and an inner cover 36. The left door 24 may include a slot 94 formed on an inner edge, and sized to receive the rotary handle latch 82, thereby locking the case doors 22, 24 closed.

In use, to deploy the stand, a user may press down on the button lock 34. By pressing down on the button lock 34, the button lock latch 30 moves upward within the button lock slot so that the beveled edge of the button lock latch disengages from the flange of the button lock 34 allowing the deploy arm 32 to pivot. As the deploy arm 32 pivots away from the enclosure bay 28, the leg 58, 66 also pivots away from the enclosure bay 28 as the slider pins 60 slide downward within the enclosure bay slots 98. The rider arm lock pin 56 of the rider arm 52, slides along the tapered body of the key latch 46 until the rider arm lock pin 56 slides into the key latch notch 48. Once the rider arm lock pin 56 is within the key latch notch 48, both the deploy arm 32 and the leg 58, 66 are prevented from pivoting any further and are also prevented from returning to the retracted position. The stand is thereby locked in the deployed position.

To unlock the stand and transition the stand back to the retracted position, the button head of the key latch 46 may be pushed downward. The key latch 46 thereby pivots about the key latch pivot pin 50 such that the body portion of the key latch 46 is pivoted away from the rider arm lock pin 56, disengaging the rider arm lock pin 56 from the key latch notch 48. Disengaging the rider arm lock pin 56 from the key latch notch 48 allows the deploy arm 32 and the leg 58, 66 to pivot back towards the enclosure bay 28. The slider pins 60 slide upward within the enclosure bay slots 98 and the rider arm lock pin 56 slides along the tapered body of the key latch 46 towards the button head. In the retracted position, the rider arm 52 may pivot into the deploy arm 32 and the deploy arm 32 pivots in between the side bars of the leg 58, 66. The beveled edge of the button lock latch 30 engages the flange of the button lock 34 such that the button lock latch 30 slides into the button lock slot tensioning the button lock spring 38. As it does, the button lock 34 captures the button lock latch 30, thereby locking the stand in the retracted position.

It should be understood, of course, that the foregoing relates to exemplary embodiments of the invention and that modifications may be made without departing from the spirit and scope of the invention as set forth in the following claims.

What is claimed is:

1. A stand for an object comprising:

an enclosure bay disposed on a surface of the object; wherein the enclosure bay comprises vertical slots;

a deploy arm comprising a top end and a bottom end, wherein the bottom end is pivotally secured within the enclosure bay; and a leg pivotally secured to the deploy arm in between the top end and bottom end, wherein the leg comprises slider pins slidably engaged within the vertical slots of the enclosure bay, wherein the stand comprises a deployed position comprising the deploy arm and the leg pivoted away from the enclosure bay and a retracted position comprising the deploy arm and the leg pivoted towards and disposed within the enclosure bay, the slider pins slide in a first direction within the vertical slots when the stand transactions from the retracted position to the deployed position, and the slider pins slide in a second direction within the vertical slots opposite the first direction when the stand transitions from the deployd position to the retracted position.

2. The stand of claim 1, further comprising a rider arm pivotally secured within the enclosure bay, wherein the rider arm is operable to pivot and releasably connect with one of the deploy arm and the leg in the deployed position.

3. The stand of claim 2, further comprising a key latch comprising a button head portion and a body portion comprising a notch, wherein the key latch is pivotally connected within the deploy arm in between the button head portion and the body portion, wherein a lock pin of the rider arm fits within the key latch notch releasably securing the stand in the deployed position.

4. The stand of claim 3, wherein the rider arm comprises a slot along a length,wherein the body portion of the key latch is slidably disposed within the . slot.

5. The stand of claim 3, wherein the body portion of the key latch tapers from a wide portion adjacent the notch to the button head portion.

6. The stand of claim 1, wherein the leg comprises an upper portion and a lower portion, wherein the upper portion comprises side bars spaced apart to receive the deploy arm in between, wherein the lower portion comprises an elongated post extending downward from the upper portion.

7. The stand of claim 6, wherein each of the side bars comprises a slider pin slidably engaged within the slots of the enclosure bay.

8. The stand of claim 1, further comprising a button lock latch protruding from within the enclosure bay and releasably securing the stand in the retracted position.

9. The stand of claim 8, wherein the deploy arm further comprises a button lock with a button lock spring biasing the button lock to engage the button lock latch.

10. The stand of claim 1, wherein the object comprises an instrument case comprising a back surface, wherein the enclosure bay is either inserted into a recessed portion of the back surface or formed onto the back surface.

* * * * *